US009581346B2

(12) United States Patent
Buchholz et al.

(10) Patent No.: US 9,581,346 B2
(45) Date of Patent: Feb. 28, 2017

(54) SYSTEM FOR REGULATING THE TEMPERATURE AND HUMIDITY IN AN ENCLOSURE

(71) Applicant: WATERGY GMBH, Berlin (DE)

(72) Inventors: Martin Buchholz, Berlin (DE); Reiner Buchholz, Berlin (DE)

(73) Assignee: WATERGY GMBH, Berlin (DE)

( * ) Notice: Subject to any disclaimer, the term of this patent is extended or adjusted under 35 U.S.C. 154(b) by 373 days.

(21) Appl. No.: 14/379,753

(22) PCT Filed: Feb. 21, 2013

(86) PCT No.: PCT/EP2013/053456
§ 371 (c)(1),
(2) Date: Aug. 20, 2014

(87) PCT Pub. No.: WO2013/124355
PCT Pub. Date: Aug. 29, 2013

(65) Prior Publication Data

US 2016/0102874 A1 Apr. 14, 2016

(30) Foreign Application Priority Data

Feb. 21, 2012 (EP) ..... 12156354

(51) Int. Cl.
*F24F 3/14* (2006.01)
*F24F 5/00* (2006.01)

(52) U.S. Cl.
CPC ..... *F24F 3/1417* (2013.01); *F24F 3/1429* (2013.01); *F24F 5/0014* (2013.01)

(58) Field of Classification Search
CPC ..... F24F 3/1417; F24F 3/1429; F24F 5/0014
(Continued)

(56) References Cited

U.S. PATENT DOCUMENTS 4,180,985 A * 1/1980 Northrup, Jr. ..... B01D 53/26 62/271
4,905,479 A * 3/1990 Wilkinson ..... F24F 3/1417 165/103
(Continued)

FOREIGN PATENT DOCUMENTS

DE EP 3034953 A1 * 6/2016 ..... F24D 12/02
GB 2006422 5/1979
(Continued)

*Primary Examiner* — Ljiljana Ciric
(74) *Attorney, Agent, or Firm* — JMB Davis Ben-David

(57) ABSTRACT

A system (S) for regulating temperature and humidity in an enclosure (20), including: a thermal storage (5), a desiccant fluid (F), a second fluid (F') consisting at least partially of water, wherein the second fluid (F') includes an equilibrium humidity above the liquid desiccant, and a first and a second trickle element (1, 2), wherein the system (S) includes a first cycle (3), which is configured to supply the desiccant fluid (F) to an inlet (I) of the first trickle element (1), to let the desiccant fluid (F) pass a surface of a heat exchanger (6) for transferring heat between said first cycle (3) and a second fluid cycle (4) containing said second fluid (F'), and to pass back the desiccant fluid (F) to the inlet (I) of the first trickle element (1), wherein in said second cycle (4) the second fluid (F') is supplied to an inlet (I') of the second trickle element (2) and a run back (R) is connected to the inlet (I) of the second trickle element (2) after passing the surface of the heat exchanger (6), wherein the second trickle element (2) is designed to allow for evaporation of aqueous constituents out of the second fluid cycle (4), wherein said second fluid (F') having a reduced temperature is returned to the surface of the heat exchanger (6), and wherein the first and/or second trickle element (1, 2) is configured for exchanging heat and aqueous constituents between air and the desiccant fluid (F).

19 Claims, 5 Drawing Sheets

Figure 1:
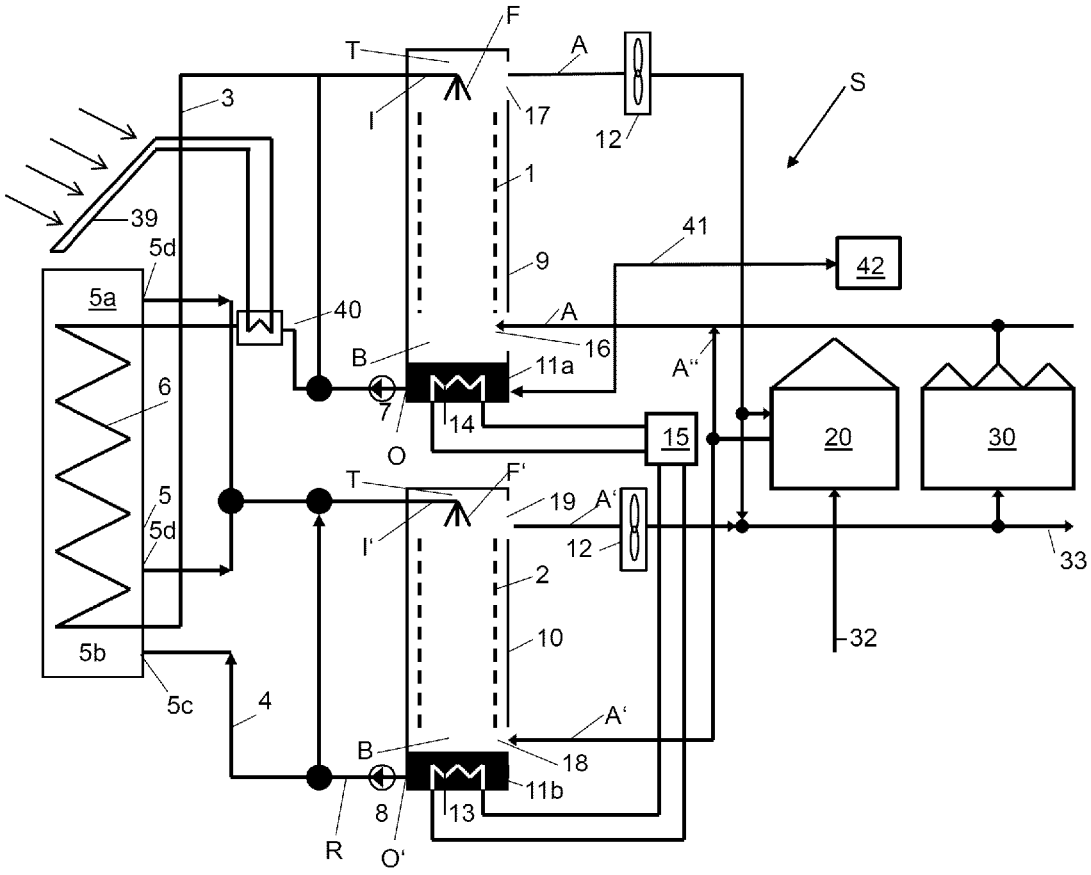

(58) Field of Classification Search
USPC ..... 62/171
See application file for complete search history.

(56) References Cited

U.S. PATENT DOCUMENTS 4,910,971 A * 3/1990 McNab ..... F24F 3/044 62/310
4,955,205 A * 9/1990 Wilkinson ..... F24F 3/1417 62/176.4
5,048,200 A * 9/1991 Ryham ..... D21F 1/48 34/114
5,058,394 A * 10/1991 Wilkinson ..... B01D 53/263 62/271
5,070,703 A * 12/1991 Wilkinson ..... B01D 53/263 62/101
5,460,004 A * 10/1995 Tsimerman ..... B01D 53/261 62/271
5,471,852 A * 12/1995 Meckler ..... B01D 53/261 62/271
6,156,102 A * 12/2000 Conrad ..... B01D 53/18 95/172
6,513,339 B1 * 2/2003 Kopko ..... F24F 3/044 62/235.1
RE39,288 E * 9/2006 Assaf ..... F24F 3/1411 62/271
2004/0031282 A1 * 2/2004 Kopko ..... F24F 3/1417 62/271
2004/0261440 A1 * 12/2004 Forkosh ..... F24F 3/1417 62/271
2006/0048538 A1 * 3/2006 Loffler ..... F24F 5/0014 62/480
2009/0095162 A1 * 4/2009 Hargis ..... B01D 53/263 96/245
2012/0125020 A1 * 5/2012 Vandermeulen ..... B01D 53/263 62/94
2013/0056177 A1 * 3/2013 Coutu ..... F28D 19/042 165/96
2013/0186121 A1 * 7/2013 Erb ..... F24F 3/1417 62/238.1
2013/0305752 A1 * 11/2013 Martin ..... F25D 17/06 62/91
2016/0033192 A1 * 2/2016 Martin ..... F24F 3/1417 62/91

FOREIGN PATENT DOCUMENTS

WO WO 2010/016040 2/2010
WO WO 2011/042126 4/2011

* cited by examiner

SYSTEM FOR REGULATING THE TEMPERATURE AND HUMIDITY IN AN ENCLOSURE

CROSS-REFERENCE TO RELATED APPLICATIONS

This is the U.S. National Stage of International Application No. PCT/EP2013/053456, filed Feb. 21, 2013, which was published in English under PCT Article 21(2), which in turn claims the benefit of EP Patent Application No. 12156354.8, filed Feb. 21, 2012.

The invention relates to a system for regulation of temperature and humidity in an enclosure.

Hygroscopic salt solutions, so-called liquid desiccants (desiccant fluids), can be used for absorption-based temperature and humidity regulation in an enclosed space. The phase change from water vapor to water causes an energy release that can be used for space heating, for heating of the salt solution used for heat transport and heat accumulation as well as for controlled heat withdrawal within space cooling applications.

By using an open absorption system based on liquid desiccants, WO 2011/042126 A1 proposes the use of liquid desiccants for drying of incoming air in combination with evaporative exhaust air cooling in the outgoing air using a plate heat exchanger. This configuration has some major limitations:

For the regeneration of the desiccant, the amount of water taken up into the desiccant material has to be driven out of the solution again. This process requires thermal energy that usually needs to be provided by an additional heat source. This can be a solar collector, a heat pump or waste heat, e.g. provided by a combustion device.

Further, by using plate heat exchangers, heat gets lost to the environment, without a possibility of accumulating heat needed for desiccant regeneration.

Finally, the use of plate heat exchangers for heat recovery or evaporative exhaust air cooling requires the air inlet and outlet to remain in the same place.

Based on the above, the problem underlying the present invention is to provide for a system of the afore-mentioned kind that is improved with respect to the above-mentioned disadvantages.

This problem is solved by a system having the features of claim 1. Preferred embodiments are stated in the sub claims and are also explained below.

According to the invention, the system comprises:

an inlet to the enclosure for passing air into the enclosure and an outlet for discharging (exhaust) air out of the enclosure, a thermal storage, a liquid desiccant (also denoted as desiccant fluid), a second fluid, consisting at least partially of water and with equilibrium humidity above the liquid desiccant, and at least two trickle elements, wherein particularly a trickle element comprises a (desiccant) fluid distributor connected to a (desiccant) inlet of the trickle element, wherein the fluid distributor distributes the desiccant fluid on a surface that may be provided by a filling (packed bed) or a fleece or some other element that is designed to decrease the flow velocity of the desiccant fluid from a top of the trickle element, where the fluid distributor is arranged, to a bottom of the trickle element, where a collecting element is arranged for collecting the desiccant fluid, which collecting element is connected to a (desiccant) outlet of the trickle element, wherein within a first cycle (desiccant cycle), the liquid desiccant is supplied to the inlet of the first trickle element, drawn out through the outlet of the first trickle element, and is then passing the surface of a liquid/liquid heat exchanger with heat transfer between the desiccant cycle and a second fluid cycle containing the (second) fluid consisting at least partially of water and being passed back to the inlet of the first trickle element, thus closing the cycle, wherein within a second cycle the second fluid is supplied to the inlet of the second trickle element and the run back (outlet) is connected to the inlet of the second trickle element after passing the surface of the heat exchanger, thus closing the second cycle, wherein further exchange of heat and aqueous constituents between air and desiccant fluid takes place in at least one of the trickle elements, and wherein evaporation of aqueous constituents out of the second fluid cycle is realized in the second trickle element, with return of fluid with reduced temperature to the surface of the heat exchanger, a thermal storage filled with at least a volume of one of the fluids involved with accumulation of heat from the absorption process and accumulation of cool from the evaporation process and with at least one fluid outlet and one fluid inlet being connected with one of the fluid cycles with direct thermal loading from the connected fluid cycle and indirect thermal loading from the other fluid cycle via the heat exchanger, wherein each trickle element is placed within a related first and second air duct, each with openings at the bottom and the top for feeding air from bottom to top in counter-flow to the fluids, and with fresh air supply to the first air duct and air inlet to the enclosure from the first air duct and exhaust air disposal into the second air duct and air disposal to the environment from the second air duct, wherein particularly dilution of liquid desiccant is realized within a first phase of air dehumidification by absorption of water vapor from air into the desiccant fluid in one of the trickle elements and transfer of heat to the thermal storage through the desiccant cycle, wherein particularly concentration of liquid desiccant is realized in a second phase of desiccant regeneration in one of the trickle elements by desorption of aqueous constituents from the liquid desiccant into the exhaust air using at least one of the following energy sources, being firstly heat from the storage volume, secondly heat from the thermal mass covering the enclosure and thirdly heat from the ground and installation of at least parts of the pipes forming the desiccant cycle and/or parts of the ducts leading the supply air through the ground, thus forming a ground heat exchanger, and wherein particularly one of the trickle elements is used alternately for two of the three processes: (1) absorption of humidity from air into the desiccant fluid, (2) desorption of water from desiccant to air, (3) evaporation of water out of the second fluid cycle, and wherein particularly transport of liquid desiccant and of the second fluid is realized with related fluid pumps and movement of air is realized using ventilators.

Thus, the invention allows in principle to use at least a part of the stored heat released from the phase change between water vapor and water for desiccant regeneration.

Further, storing of evaporative cool during the night process as well as storing of sensible heat from exhaust air, (for which plate heat exchangers are commonly used during heat recovery in a heating period), becomes possible, while additionally, latent heat from the exhaust air can be recovered by the desiccant fluid.

Finally, direct contact fluid/air heat exchangers like desiccant or water charged trickle fills according to the invention advantageously allow for spatial separation of air inlet and outlet or a combination of a central air disposal unit and several decentralized units for fresh air supply with exchange of thermal potential between the devices by desiccant fluid connectors.

According to the invention the following processes can in principle be conducted by the system:

Air dehumidification: By leading the desiccant through a trickle element in contact with the supply air going into the enclosure (in case of space cooling) or by leading the desiccant in contact with the exhaust air from the enclosure (in case of sensible and latent heat recovery), humidity from air is taken up by the desiccant and latent heat is transferred into sensible heat which can be captured at least partially by the desiccant flow.

Heat transport and storage: Humidity and sensible heat are captured and transported by the desiccant stream. Sensible heat can be used for desiccant regeneration during heat recovery mode, while in the same process released humidity and heat are used directly for supply air humidification and heating of the enclosure. Alternatively, sensible heat can be stored in a thermal storage for delayed use in a later period, either for space heating or for desiccant regeneration only.

Desiccant regeneration: In addition to heat from the thermal buffer, further low temperature heat sources can be used for the regeneration process. In space heating mode, the desiccant and/or the supply air can be sufficiently preheated by ground heat in order to fall below the equilibrium humidity of the desiccant. In space cooling mode, the process of desiccant regeneration runs in a separate phase in the exhaust air stream during the night, using thermal heat from the storage generated during daytime to heat the desiccant. In addition, thermal heat passively stored in the construction material of the enclosure is used to heat the outgoing air.

Generation and accumulation of cold: To generate additional cold, the second fluid consisting at least partially of water and with higher equilibrium humidity compared to the desiccant fluid is led to the trickle element in the exhaust air stream. Evaporation of water from the fluid allows cooling of the fluid and can later be used to further cool down the desiccant as passing the heat exchanger. To that end, cold storage medium is returned to a cold zone of the storage, while the hot desiccant cycle in the daytime is transferring heat to a hot zone of the storage, while being cooled down on the cold zone of the storage. A further phase of cold accumulation may run simultaneously to, or may follow the desiccant regeneration phase during night. For this purpose, the fluid cools down by evaporating parts of its water content into the exhaust air and is then returned and accumulated in the storage for the next cooling phase during daytime. Partially separating the three phases of space cooling, desiccant regeneration and cool accumulation allows for solving the contrary needs of storing heat (for regeneration) and cool (for space cooling).

According to an aspect of the invention, at least one of the trickle elements is placed directly on the inner surface of its surrounding air duct.

According to a further aspect of the invention, at least one of the air ducts is exposed outside of the enclosure allowing direct exchange of heat between the duct surface and the environment.

According to yet another aspect of the invention, the second air duct is designed as a double-walled duct and the second trickle element is placed on the inner surface of the outer wall and on the outer surface of the inner wall and the supply air into the enclosure is firstly directed through the first duct, then through the inner volume of the double-walled second duct into the building (enclosure) and the exhaust air is directed through the outer volume of the double-walled second duct and then disposed into the environment.

Particularly, a third duct is disposed towards solar radiation and the desiccant cycle is connected between the first heat exchanger and the inlet of the first trickle element and from its outlet to the inlet of the third trickle element placed on the inner wall of the third duct, and from its outlet back to the heat exchanger.

In another embodiment of the invention, the exhaust air of the enclosure is directed to a central, second trickle element, and fresh air is directed through at least two decentralized and spatially separated trickle elements, each of the same principle design as the first trickle element.

Further, the heat storage may at least be partially filled with a phase change material (PCM), preferably designed as encapsulated partial volumes, particularly separated from the partial volume of the passing fluid by at least one PCM container.

According to an aspect of the invention, at least one second heat exchanger is placed in one or in both trickle elements, being in contact with the solutions running down the trickle fill and the second fluid cycle connects the outlet of the storage with one or both heat exchangers in a row and connects back to the inlet of the thermal storage, while the desiccant cycle is connecting a first trickle element and a desiccant storage and a further water cycle (second fluid) connects the second trickle element with a water storage.

According to a further aspect of the invention a heat pump is connected via a hot water cycle with a heat exchanger in contact with the fluid returning from one of the trickle elements and is connected via a cold water cycle with a heat exchanger in contact with the fluid returning from the other trickle element.

Preferably, during a phase of daytime air dehumidification, firstly supply air to the enclosure is led through the first trickle element, passing aqueous constituents and heat from air to the desiccant and transporting heat through the heat exchanger from the desiccant cycle to the upper hot area of the storage, and secondly exhaust air is led through the second trickle element, passing aqueous constituents from the second fluid cycle to the outgoing air and returning fluid of reduced temperature to the lower cold area of the storage.

Further, during a phase of night-time desiccant regeneration, supply air to the enclosure is preferably led through an adjustable opening and exhaust air is preferably led through the first trickle element receiving aqueous constituents from the desiccant cycle.

Further, during a phase of night-time thermal regeneration, supply air to the enclosure is preferably led through an adjustable opening and exhaust air is preferably led through the second trickle element receiving aqueous constituents from the second fluid cycle and fluid of reduced temperature is preferably returned to the storage.

According to another embodiment of the invention, humid and warm exhaust air is led to the first trickle element and humidity and heat are transferred from air to the desiccant cycle and the desiccant is optionally led either through the storage heat exchanger or directly led to the second trickle element transferring humidity and heat to the supply air, and from there the desiccant is led back to the first trickle element, thus closing the cycle.

According to a further aspect of the invention, concentrated desiccant solution is at least partially stored in a desiccant storage and is further transported with delay to the first trickle element in periods with higher heat and/or humidity load in the exhaust air from the enclosure.

According to a further aspect of the invention, supply air is first led through a ground heat exchanger and from there to the second trickle element taking up aqueous constituents from the liquid desiccant and from there is released back to the environment through a controllable flap without entering the enclosure, thus regenerating the hygroscopic property of the desiccant.

According to a further aspect of the invention, supply air is led through the second trickle fill element taking up aqueous constituents from the liquid desiccant and from here is released to the duct leading back to the environment without entering the enclosure and a desiccant cycle is pumped between the second trickle element and a ground heat exchanger, thus regenerating the hygroscopic property of the desiccant.

According to a further aspect of the invention, a greenhouse is forming a second enclosure and air from the greenhouse, before it is led to the first enclosure, is passing the first trickle element and air from the first enclosure is led back to the greenhouse by passing the second trickle element, thus forming an at least partially closed air cycle.

According to a further aspect of the invention, air from the greenhouse is led to one of the trickle elements and from there back to the greenhouse and heat released into the liquid desiccant is directed from the trickle element to the storage through the storage heat exchanger in the desiccant cycle.

According to a further aspect of the invention, the walls of the second air duct is formed by the outer shell and ground surface of a greenhouse and the second trickle element is formed by the substrata of the greenhouse vegetation and the exhaust air from the greenhouse is led to the air inlet of the first trickle element and the air coming out of this element is again connected with the air inlet to the greenhouse, thus forming a closed air cycle.

According to yet another aspect of the invention, during daytime, the second fluid cycle in the greenhouse is led to the substrata as irrigation water through an irrigation system and during night is recollected by installed gutters, collecting condensed water dripping off the inner surface of the greenhouse walls, after being intermediately absorbed in and desorbed from the desiccant cycle via the first trickle element.

Figure 2:
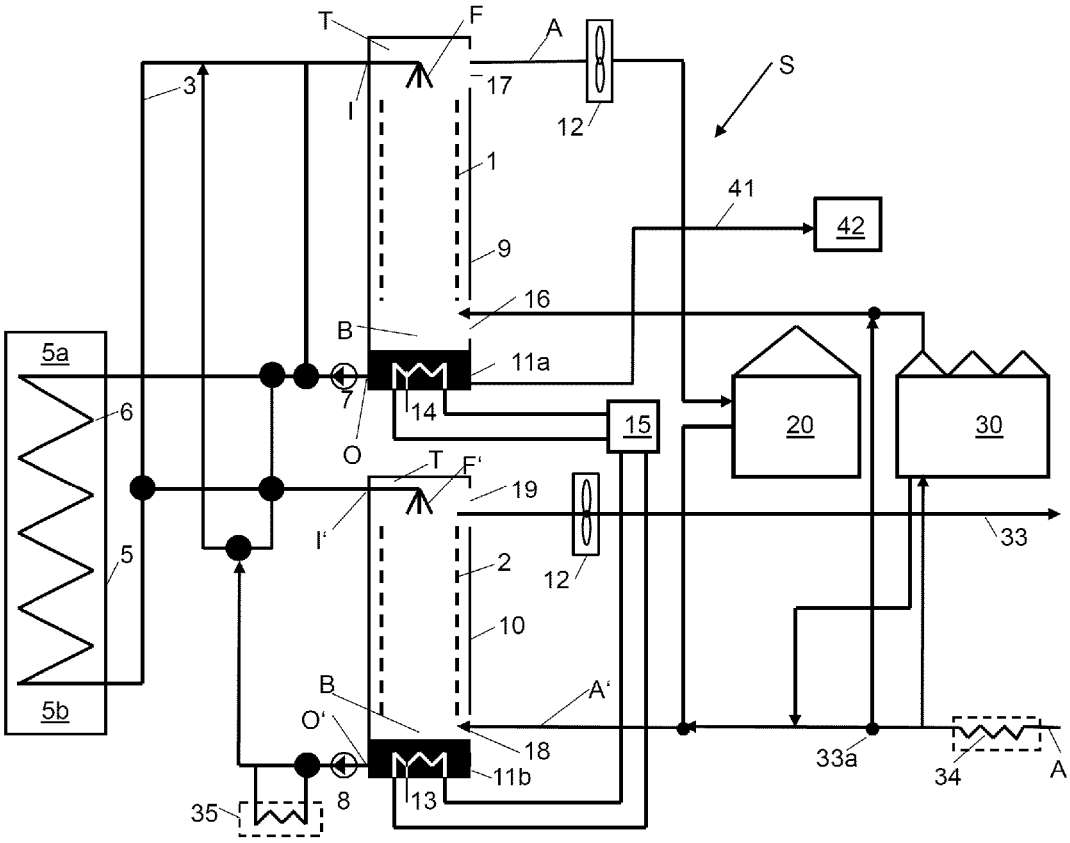
Figure 3:
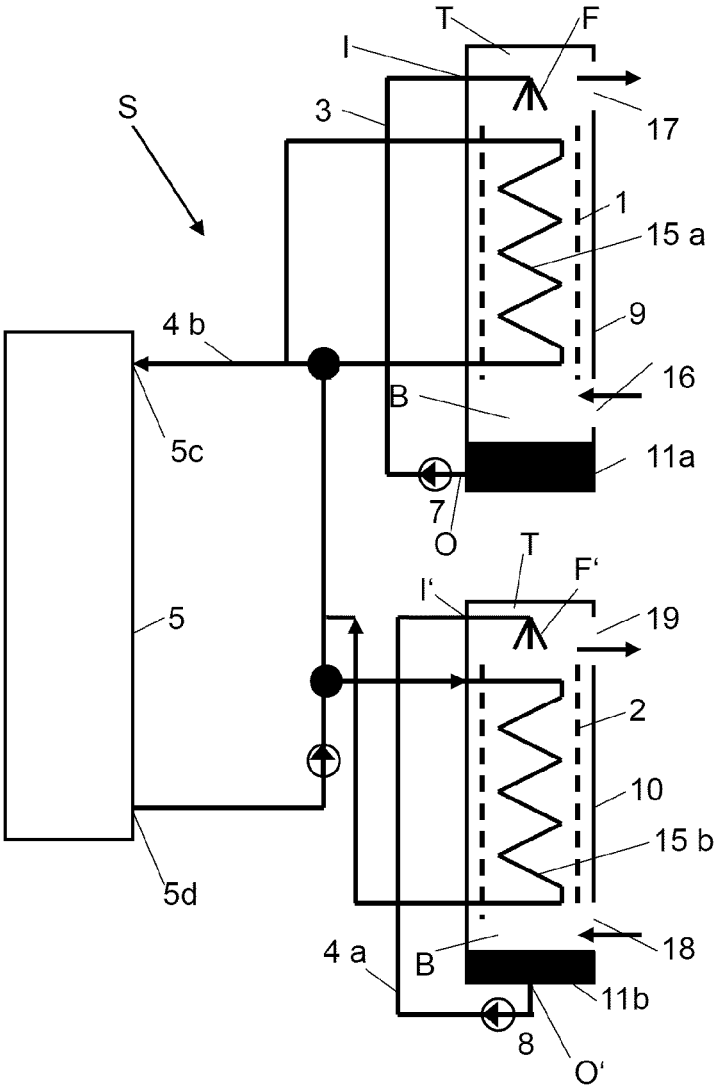
Figure 4:
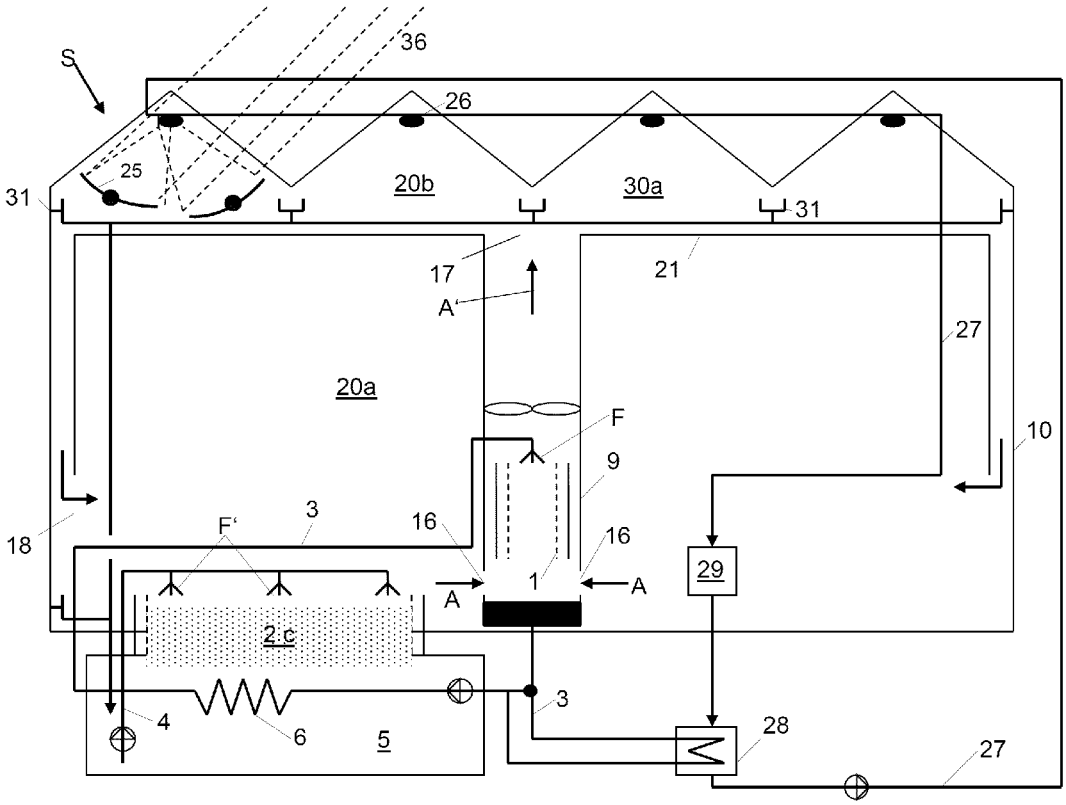
Figure 5:
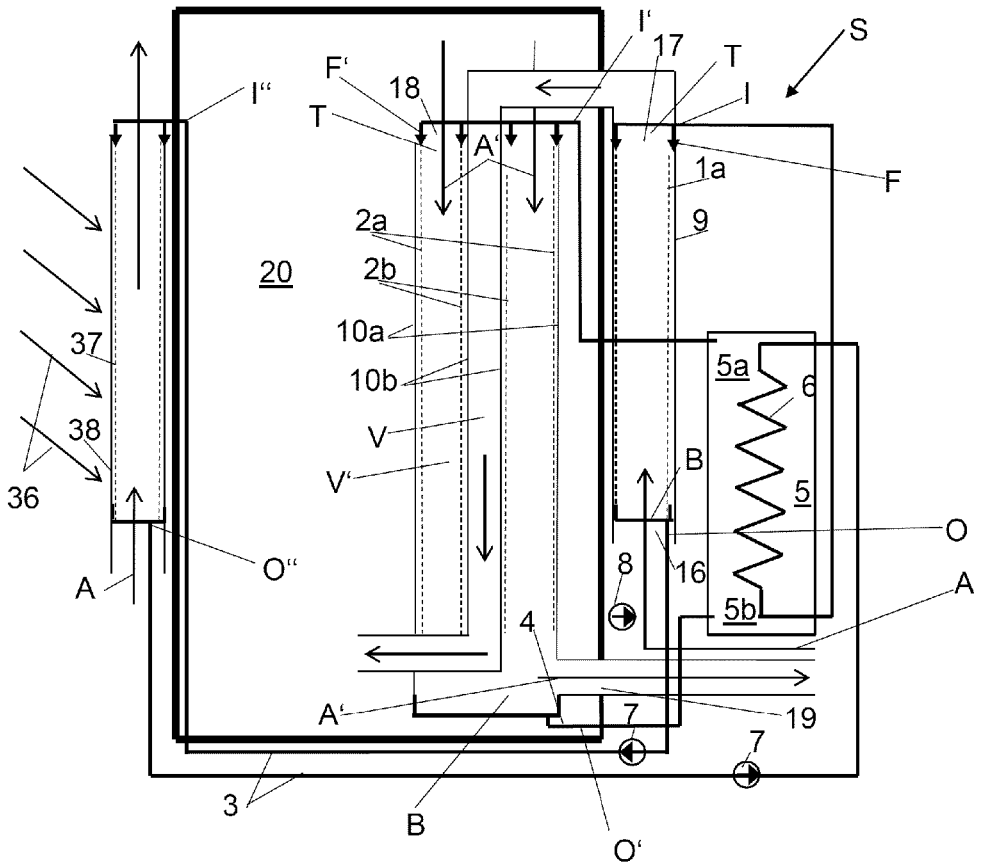

Further features and advantages of the invention shall be described by means of detailed descriptions of embodiments with reference to the Figures, wherein FIG. 1 shows a configuration in which a desiccant cycle connects a first trickle element with a heat exchanger placed in a thermal storage, and FIG. 2 shows the operation of heat recovery during a space heating period, and FIG. 3 shows an alternative configuration with the heat exchanger placed within the trickle elements, and FIG. 4 shows another alternative configuration for climate control in a greenhouse, and FIG. 5 shows an example with trickle elements placed directly on the inner surface of the surrounding air ducts.

FIG. 1 shows a configuration in which a desiccant cycle (first cycle) 3 connects a first trickle element 1 with a heat exchanger 6 placed in a thermal storage 5. Supply air A to the enclosure 20 is dehumidified and cooled by the desiccant cycle 3 that takes cool from the cold area 5*b* of the storage 5 to the trickle element 1 and returns heat to the hot area 5*a* of the storage 5 by passing the heat exchanger 6. Heat accumulation in the storage 5 for improved desiccant regeneration capacity can be enhanced by a secondary heat source, preferably a solar collector 39, transferring heat directly or indirectly through a heat exchanger to the desiccant cycle 3 between the outlet O of the first trickle element 1 and an inlet of the heat exchanger 6. Exhaust air A' from the building (enclosure) 20 is led through the second trickle element 2 and takes up water vapor from the second fluid cycle 4 leading from the thermal storage 5 into the trickle element 2 and returning to the cold area 5*b* of the storage 5. During the night, in a regeneration phase, supply air is led directly into the enclosure through a controllable opening 32, is heated up by the thermal mass of the enclosure 20 and then, as exhaust air A", directed further through the first trickle element 1, where aqueous constituents are evaporated out of the desiccant F using heat from the thermal storage 5, thus regenerating the hygroscopic property of the desiccant (fluid) F. During a later phase in the night, when at least parts of the storage volume drops below temperatures needed for desiccant regeneration, exhaust air A' is led through the second trickle element 2 and takes up water vapor from the second fluid cycle 4 that is pumped out of an area with intermediate or warm temperature 5*a* of the storage 5, is then passing the second trickle element 2, and is finally returned to the cold area 5*b* of the storage 5, thus accumulating cool for the next daytime cooling phase. The process can be optimized by using a heat pump 15 that allows further temperature stratification between the hot and cool areas of the storage 5*a*, 5*b* through a heat exchanger 14, further heating the desiccant cycle 3 before the entry of the heat exchanger 6 integrated in the storage unit and further cooling the second fluid cycle 4 before the entry of the cool area 5*b* of the storage 5, optimizing both the regeneration process using heat and the space cooling process using cold. Optionally, desiccant fluid F stored in a desiccant storage 11*a* can be replaced through a connection 41 by either diluted or concentrated desiccant fluid 42 in case of a non-equalized water balance in the system.

FIG. 2 shows the operation of heat recovery during a space heating period. In the default configuration, the desiccant cycle (first cycle) 3 first passes the second trickle element 2, taking up humidity and heat from the exhaust air A' of the enclosure 20, and is then led to the first trickle element 1, where absorbed heat and humidity are passed back to the fresh air A to the enclosure 20. In case of temporary high heat or humidity loads in the building, the warm desiccant F can be passed from the second trickle element 2 through the heat exchanger 6 in the thermal storage 5 and from there to the first trickle element 1, thus storing heat that can be delivered back to the supply air A into the enclosure 20 with delay, according to the given heating demand within the enclosure 20. A heat pump 15 increases the function of exhaust air heat recuperation by bringing a colder desiccant F in contact with the exhaust air through the heat pump cold cycle heat exchanger 14, while achieving a higher desiccant temperature for heating the supply air through the heat pump hot cycle heat exchanger 13. For further regeneration of the desiccant F, supply air A optionally preheated by a ground heat exchanger 34 is led through the second trickle element 2 where it is in contact with the desiccant F, optionally preheated by a ground heat exchanger 35, and the air, after being humidified by the desiccant, is transported to a channel 33 leading back to the environment.

Optionally, instead of providing fresh air A from the environment, all or part of the exhaust air can be led to a greenhouse 30, where $CO_2$ from the enclosure is transferred into oxygen by the vegetation's photosynthetic activity, and where the air is humidified further and then led back into the enclosure through the first trickle element, where the desiccant F can take up the humidity as a source of solar energy.

FIG. 3 shows an alternative configuration, wherein the desiccant F circulates through the first trickle element 1 and water F' (second fluid) circulates through the second trickle element 2, and heat transfer between the trickle elements 1, 2 and the storage 5 is managed by a closed storage fluid cycle 4*b*, passing at least one of the heat exchangers 15*a*, 15*b* installed within the trickle elements 1, 2.

FIG. 4 shows an alternative configuration, wherein the air duct 10 containing the second trickle element 2 is built by the outer walls and the ground surface of a greenhouse 30*a*, thus forming the enclosure. The desiccant cycle 3 feeds the first trickle element 1, in which the greenhouse air A is led into and dehumidified. Heat gained from the phase change process is transported by the desiccant cycle 3 into the thermal storage 5. The second trickle element 2*c* is built by the surface of the substrata, and is further extended by the leaf surface of the greenhouse plants. The second fluid cycle 4 passes water to the irrigation system 4*a*, thus allowing for evaporation and resulting cooling of the greenhouse air. The volume of the enclosure 20 is separated preferably with an internal foil 21 forming a hot upper 20*b* and a cold lower partial air volume 20*a* (such a separation may also be achieved without a foil by stratification of the air by thermal layers), and exhaust air A' from the first air duct 9, heated through the absorption process, is led to the upper hot area 20*b* of the air volume, releasing heat through the outer cover of the enclosure, and then passed back to the lower zone 20*a*, which is cooled by the evaporative activity of the second trickle element 2, comprised of the wet substrata and vegetation growing in the substrata. During the night, heat from the storage 5 is used for desiccant regeneration in the first trickle element 1, and hot and humid air is passed to the upper zone 20*b*, where air humidity is condensed on the cold inside surface of the enclosure 10 and can be collected by installed gutters 31. Solar absorbing elements 26 installed in the upper zone 20*b* can further increase temperature stratification between the hot and cold zone 20*a*, 20*b* by shading the vegetation surface in the lower zone 20*a* and further heating of the air in the hot zone 20*b*. The solar absorbing elements 26 are preferably hollow and connect a heat conducting fluid cycle, passing heat from the solar absorbing elements to the desiccant cycle using a further heat exchanger 28. The solar absorbing elements ideally receive further radiation of the infrared spectrum (of the radiation of the sun 36) using reflectors 25, particularly coated NIR—reflectors 25, below the solar absorbing elements 26, allowing photo synthetically active radiation from UV and visible light to pass on to the vegetation while reflecting and preferably concentrating infrared light onto the solar absorbing elements by using a photo selective coating. The reflectors 25 may be designed to be movable, to follow the radiation 36. Optionally, the heat gained in the heat conducting fluid cycle can be used to run a further thermal consumer 29 such as a steam turbine, and the consumer's cooling water is cycled between the consumer and the heat exchanger 28, passing waste heat from the consumer process to the desiccant cycle. In this way, concurring needs, like the generation of cool for greenhouse climate control, the generation and storage of heat for the desiccant regeneration and the need of light for photosynthetic activity are satisfied.

FIG. 5 shows an example with trickle elements 1, 2 placed directly on the inner surface of the surrounding air ducts 9, 10*a*, 10*b*. This allows direct heat transfer through the walls of the duct, as they are in direct contact with the fluids F, F'. The first air duct 9 containing the first trickle element 1*a* is placed on an outer wall of the enclosure 20, preferably not exposed to the sunlight. Incoming humid and hot air A (through air inlet 16) from the environment is dehumidified and cooled by the cool desiccant F with cool provided by the thermal storage 5, while the heat generated by the phase change is partially emitted to the environment through the walls of the duct 9 and partially transported with the flow of the desiccant cycle 3 and partially transported by the passing air. The second trickle element 2*a*, 2*b* is placed in a double-walled tube, and the supply air A to the enclosure 20 is led from the air outlet 17 of the first trickle element 1*a* through the inner tube 10*b* of the double-walled air duct into the enclosure 20. The exhaust air A' from the enclosure 20 is led to the second trickle element 2*a*, 2*b* through its air inlets 18, which is placed on the surfaces of the inner wall of the outer tube 10*a* and on the outer wall of the inner tube 10*b*. The second fluid F' is transported from the thermal storage 5 to the second trickle element surfaces 2*a*, 2*b* and back to the cold area 5*b* of the thermal storage 5, thus allowing to accumulate cool from the evaporation process in the thermal storage 5. The walls of the tubes are cooled by evaporation of water to the exhaust air A'. In this way, the incoming air A and the air volume in the enclosure 20 are cooled as they are in direct contact with the related cooled walls of the tube. Depending on given climate conditions in the environment, air from the environment can optionally be led through a third air tube (air duct) 38, containing a third trickle element 37 on the inner walls which then receives the desiccant F (via its inlet I") from the outlet O of the first trickle element 1. The tube 38 is preferably installed on the sun-exposed side of the enclosure 20 and receives solar radiation 36 heating up the tube 38, and thus allows to further evaporate aqueous constituents out of the desiccant F and regeneration of the desiccant F is achieved. The desiccant cycle 3, in this case is extended to this third trickle element 37 and passes from the outlet O" of the third trickle element 37 through the heat exchanger 6 in the thermal storage 5 transferring remaining heat from the desiccant cycle 3 to the storage fluid, and then returns to the (inlet I of the) first trickle element 1*a*, thus closing the cycle.

The invention claimed is:

1. A System for regulating temperature and humidity in an enclosure, comprising:

a thermal storage, a desiccant fluid, a second fluid consisting at least partially of water, wherein particularly the second fluid comprises an equilibrium humidity above the liquid desiccant, and a first and a second trickle element, wherein the system comprises a first cycle, which is configured to supply the desiccant fluid to an inlet of the first trickle element, to let the desiccant fluid pass a surface of a heat exchanger for transferring heat between said first cycle and a second fluid cycle containing said second fluid, and to pass back the desiccant fluid to the inlet of the first trickle element, wherein in said second cycle the second fluid is supplied to an inlet of the second trickle element and a run back is connected to the inlet of the second trickle element after passing the surface of the heat exchanger, wherein the second trickle element is designed to allow for evaporation of aqueous constituents out of the second fluid cycle, wherein said second fluid having a reduced temperature is returned to the surface of the heat exchanger, wherein the first and/or second trickle element is configured for exchanging heat and aqueous constituents between air and the desiccant fluid, a thermal storage having a fluid outlet and a fluid inlet being connected with the first or the second fluid cycle, wherein the thermal storage is configured for direct thermal loading from the connected fluid cycle and indirect thermal loading from the other fluid cycle via the heat exchanger, wherein the first trickle element is placed within an associated first air duct and the second trickle element is placed within an associated second air duct, wherein each air duct comprises a bottom and a top, wherein the system is configured to feed air from the respective bottom to the respective top in counter-flow to the respective fluid, and wherein the first air duct comprises an air inlet at the top for supplying supply air to the first air duct, and an air outlet at the bottom for passing said air from the first air duct to the enclosure, and wherein the second air duct comprises an air inlet at the bottom for passing air from the enclosure to the second air duct, and an air outlet at the top for passing said air from the second air duct to an environment surrounding the enclosure or back to the enclosure.

2. The system as claimed in claim 1, wherein the system is configured to dilute the desiccant fluid in a first phase of air dehumidification by absorbing water vapor from air into the desiccant fluid in the first or the second trickle element, wherein the system is particularly configured to transfer heat to the thermal storage through the first cycle.

3. The system as claimed in claim 1, wherein the system is configured to concentrate the desiccant fluid in a second phase of desiccant regeneration in the first or the second trickle element by desorbing aqueous constituents from the desiccant fluid into exhaust air from the enclosure being passed to the air inlet of the respective trickle element using particularly at least one of the following energy sources: heat from the thermal storage, heat from the thermal mass of the enclosure, heat from a ground, heat from at least one pipe being a part of the first cycle, and/or heat from a duct leading air through the ground to the air inlet of the first trickle element.

4. The system as claimed in claim 1, wherein the first or the second trickle element is configured to alternately conduct two of the following processes: absorption of humidity from air into the desiccant fluid, desorption of water from the desiccant fluid to air, and of evaporation of water out of the second fluid cycle.

5. The system as claimed in claim 1, wherein the system is configured to transport the desiccant fluid and/or the second fluid by means of at least one fluid pump, and wherein particularly the system is configured to transport air out of the air ducts by means of ventilators.

6. The system as claimed in claim 1, wherein at least one of the trickle elements is placed directly on an inner surface of its surrounding air duct.

7. The system as claimed in claim 1, wherein at least one of the air ducts is exposed to the environment surrounding the enclosure, so as to allow for direct exchange of heat between a surface of the respective air duct and the environment.

8. The system as claimed in claim 1, wherein the second air duct is designed as a double-walled air duct comprising an inner wall and an outer wall encompassing the inner wall, and wherein the second trickle element is placed on an inner surface of the outer wall and on an outer surface of the inner wall, wherein particularly the second air duct is configured such that supply air that is to be passed into the enclosure is firstly directed through the first air duct being connected to an inner volume of the second air duct, which inner volume is delimited by the inner wall, then through said inner volume into the enclosure, particularly in the form of a building, wherein the system is further configured to direct exhaust air through an outer volume of the second air duct into the environment of the enclosure, which outer volume is delimited by the inner wall and the outer wall.

9. The system as claimed in claim 1, wherein a third air duct is provided that is designed to be disposed towards solar radiation, wherein the first cycle extends from the heat exchanger to the inlet of the first trickle element and from an outlet of the first trickle element to an inlet of a third trickle element placed on an inner surface of the third air duct, and from an outlet of the third trickle element back to the heat exchanger.

10. The system as claimed in claim 1, wherein the system is configured to direct exhaust air of the enclosure to the second trickle element, and supply air through the first trickle element and through a further first trickle element, particularly of the same design as said first trickle element, wherein the two first trickle elements are spatially separated.

11. The system as claimed in claim 1, wherein the thermal storage is at least partially filled with a phase change material, preferably designed as encapsulated partial volumes, wherein particularly the phase change material is separated from the partial volume of the second fluid by at least one phase change material container.

12. The system as claimed in claim 1, wherein the system is configured to direct supply air, particularly during a phase of daytime air dehumidification, to the enclosure through the first trickle element, which is configured to pass aqueous constituents and heat from said supply air to the desiccant fluid, and to transport heat through the heat exchanger from the first cycle to an upper hot area of the thermal storage, as well as to direct exhaust air through the second trickle element, which is configured to pass aqueous constituents from the second fluid cycle to said exhaust air, and to return second fluid of reduced temperature to a lower cold area of the thermal storage, wherein particularly the system is configured to direct supply air, particularly during a phase of night-time desiccant regeneration, to the enclosure through an adjustable opening, and to direct exhaust air through the first trickle element, so that the exhaust air receives aqueous constituents from the desiccant fluid, and wherein particularly the system is configured to direct air, particularly during a phase of night-time thermal regeneration, to the enclosure through an adjustable opening, and to direct exhaust air through the second trickle element, so that the exhaust air receives aqueous constituents from the second fluid, and to return second fluid of reduced temperature to the thermal storage.

13. The system as claimed in claim 1, wherein the system comprises a desiccant storage for storing concentrated desiccant fluid, wherein particularly the system is configured to transport said desiccant fluid from said desiccant storage to the first trickle element in periods with higher heat and/or humidity load in the exhaust air from the enclosure, and wherein particularly the desiccant storage comprises a connection to an external source of desiccant fluid for exchanging diluted desiccant fluid and concentrated desiccant fluid.

14. The system as claimed in claim 1, wherein the system is configured to direct supply air through a ground heat exchanger and from there via a controllable flap to the second trickle element, so that said air takes up aqueous constituents from the desiccant fluid, and to release said air from there without entering the enclosure back to the environment of the enclosure, wherein particularly the controllable flap can be connected to the air inlet of the first trickle element.

15. The system as claimed in claim 1, wherein the system is configured to direct supply air through the second trickle fill element, so that said air takes up aqueous constituents from the desiccant fluid, and to release said air from there without entering the enclosure to a duct leading back to the environment surrounding the enclosure, and to pump the desiccant fluid in the first cycle connecting the second trickle element to a ground heat exchanger.

16. The system as claimed in claim 1, wherein the system comprises a greenhouse forming a further enclosure, wherein the system is configured to let air from the greenhouse pass the first trickle element before leading it to the enclosure, and to lead air from the one enclosure back to the greenhouse through the second trickle element.

17. The system as claimed in claim 16, wherein the system is configured to lead air from the greenhouse to one of the trickle elements and from there back to the greenhouse, and to direct heat released into the desiccant fluid from the respective trickle element to the thermal storage through the heat exchanger.

18. The system as claimed in claim 1, wherein a wall of the second air duct is formed by an outer shell and a ground surface of a greenhouse, and the second trickle element is formed by a substrata of a vegetation in the greenhouse, wherein the system is configured to lead exhaust air from the greenhouse to the air inlet of the first trickle element and air coming out of this element to an air inlet to the greenhouse.

19. The system as claimed in claim 18, wherein the system is configured to lead the second fluid, during daytime, to the substrata as irrigation water through an irrigation system, and to recollect it, during night, by installed gutters that are designed to collect condensed water dripping off an inner surface of a wall of the greenhouse, particularly after being intermediately absorbed in and desorbed from the first cycle via the first trickle element.

* * * * *